United States Patent [19]

Brockhaus

[11] Patent Number: 4,619,016

[45] Date of Patent: Oct. 28, 1986

[54] HINGE ATTACHMENT ARRANGEMENT FOR AN ADJUSTABLE, DETACHABLE ATTACHMENT OF MOTOR VEHICLE DOORS

[75] Inventor: Ernst Brockhaus, Remscheid-Hasten, Fed. Rep. of Germany

[73] Assignee: ED. Scharwächter GmbH & Co. KG, Remscheid, Fed. Rep. of Germany

[21] Appl. No.: 783,256

[22] Filed: Oct. 2, 1985

Related U.S. Application Data

[63] Continuation of Ser. No. 567,530, Jan. 3, 1984, abandoned.

[30] Foreign Application Priority Data

Jan. 3, 1983 [DE] Fed. Rep. of Germany ..... 3300006

[51] Int. Cl.[4] ..... E05D 5/02

[52] U.S. Cl. ..... 16/383

[58] Field of Search ..... 16/382, 383, 384; 411/500, 501

[56] References Cited

U.S. PATENT DOCUMENTS

| | | | |
|---|---|---|---|
| 1,124,048 | 1/1915 | Malaspina | 16/382 X |
| 1,835,042 | 12/1931 | Hammer | 16/382 |
| 3,686,709 | 8/1972 | Tuvert | 16/383 |
| 4,104,952 | 8/1978 | Brass | 411/500 |
| 4,398,307 | 8/1983 | Ginsburg et al. | 16/384 X |

FOREIGN PATENT DOCUMENTS

| | | | |
|---|---|---|---|
| 1906989 | 2/1969 | Fed. Rep. of Germany | 411/500 |

*Primary Examiner*—F. Silverberg

*Attorney, Agent, or Firm*—Toren, McGeady, Stanger, Goldberg & Kiel

[57] ABSTRACT

A hinge attachment arrangement for mounting a door on a motor vehicle includes a pair of hinge wings interconnected by a hinge pin with one hinge wing to be secured to a vehicle door and the other to a fastening element secured to the door frame on the vehicle. The other hinge wing is secured to the fastening element by at least one bolt. The other hinge wing and the fastening element also have at least one continuous borehole for receiving a plug or bolt when the other hinge wing is attached to the fastening element. The borehole and the plug or bolt form guide surfaces which slide one relative to the other so that the guide surfaces afford self-centering and the elimination of play in the assembly of the hinge attachment arrangement.

7 Claims, 4 Drawing Figures

HINGE ATTACHMENT ARRANGEMENT FOR AN ADJUSTABLE, DETACHABLE ATTACHMENT OF MOTOR VEHICLE DOORS

This is a continuation of application Ser. No. 567,530, filed Jan. 3, 1984 now abandoned.

SUMMARY OF THE INVENTION

The present invention is directed to a hinge attachment arrangement for motor vehicle doors where a wing type hinge is used made up of two hinge wings connected together by a hinge pin. One hinge wing is rigidly connected to the vehicle door in the usual manner. The other hinge wing is detachably fastened by bolts to a fastening element secured to the door frame of the vehicle body. Guide surfaces disposed at least in part on the other hinge wing and the fastening element are arranged so that the guide surfaces slide relative to one another when the hinge attachment arrangement is assembled. Further, the holes for securing the other hinge wing to the fastening element by means of bolts are made oversized.

Hinge attachment arrangements are known for mounting vehicle doors on a vehicle body while they are still in the unfinished state and making the final adjustments for the alignment of the door. The doors, however, must be temporarily removed so that the final assembly is carried out after painting the vehicle body and outfitting its interior whereby the assembly work can be facilitated. When outfitting the interior of the vehicle is completed, it should be possible to remount the doors on the vehicle body and without further adjustments so that the assembly costs are kept to a minimum. Considering the usually very constricted door hinge assembly conditions which result from the design of the vehicle body and the doors,it has been possible to achieve the desired assembly. One prerequisite for the accurate remounting of the doors on the vehicle body is that there is great precision in the production of the hinge wings and the fastening elements and, in particular, the portions of these members which interact as guide surfaces. The requirement for great precision presupposes appropriate production methods and controls which, in turn, increase the hinge production costs.

Therefore, it is the primary object of the present invention to provide a hinge attachment arrangement so that without any additional costs for the production of the hinge wings and fastening elements, adjustments in the final installation of the vehicle door can be eliminated and the interacting bearing surfaces on the fastening element and the hinge wing can be placed in contact without any play.

In accordance with the present invention, the guide surfaces at least on one of the components of hinge attachment arrangement, that is, the hinge wing and the fastening element, are provided so that self-centering takes place and play is eliminated. It is preferable if the guide surfaces are formed in part by a plug or bolt fastenable to one of the components of the attachment assembly, that is, within a borehole in the component for receiving the plug or bolt.

One special feature of the invention is that the plug or bolt, fastenable to one of the components of the assembly, is arranged to be spread apart over a portion of its axial length in the other component of the assembly to eliminate play between the two components of the attachment arrangement when the door is being finally installed. Accordingly, when the door is being mounted during the final assembly, it is possible to eliminate play between the hinge wing and the corresponding fastening element, which play impairs the exact adjustment of the door, by spreading apart the axial length section of the bolt or plug inserted in a through-hole or borehole within the hinge wing and fastening element with the spreading action being achieved by a simple prying. Such assembly can be effected without incurring additional costs. By eliminating any possible play between the hinge wing and the fastening element in an absolutely reliable manner, it is possible to permit certain tolerances in the production of the components making up the hinge attachment arrangement so that the production of the components is considerably reduced without any disadvantages in the hinge attachment arrangement.

Another feature of the invention is that the plug or bolt secured to one of the hinge wing or the fastening element is tapered over a portion of its axial length within the portion of the borehole formed in the other one of the hinge wing or fastening element. The tapered arrangement of the plug or bolt affords a certain centering of the interacting guide surfaces during the assembly of the hinge attachment arrangement and also provides mutual alignment of the hinge wing and the fastening element.

The spreadability of an axially extending section of the plug or bolt secured in the hole formed through the components of the hinge attachment arrangement is achieved by providing at least one axially extending recess within a portion of the bolt or plug. In a preferred embodiment of the invention, the plug or bolt is in the form of a threaded bolt tapering over a portion of its axial length from the head of the bolt, in the manner of a countersunk bolt, with a corresponding taper in the borehole or through-hole in one of the hinge wing or fastening element making up the hinge attachment arrangment so that the threaded bolt interacts with the other member of the attachment arrangement within a tapped hole. When the threaded bolt is tightened during the final assembly of the vehicle door, the two components of the hinge attachment arrangement become mutually aligned without any play so that the door is aligned in the desired adjusted position.

According to another preferred embodiment of the invention, the guide surfaces are formed in part by a plug tapered over a portion of its axial length and having an internal axially extending bore and by a cylindrical hole formed in one of the components forming the hinge attachment arrangement. When the door is installed during the final assembly of the vehicle the tapered plug first effects a certain mutual alignment of the two components of the attachment arrangement relative to one another, and the final alignment without any play of the components being accomplished by spreading the hollow plug within the cylindrical hole, that is, by spreading or prying the plug apart.

Finally, in another preferred embodiment of the invention, the guide surfaces are formed in part by two plugs fastened to one of the hinge attachment arrangement components with the plugs tapered over a short section of their length and each provided with an internal axially extending bore. Two cylindrical holes are formed in the other component of the hinge attachment arrangement so that the plugs secured within the one component afford a coarse mutual alignment of the two components relative to one another by means of the tapered sections when the vehicle door is remounted during the final assembly. A mutual alignment of the two hinge attachment arrangement components is achieved by spreading the hollow plugs apart, such as by a prying action.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
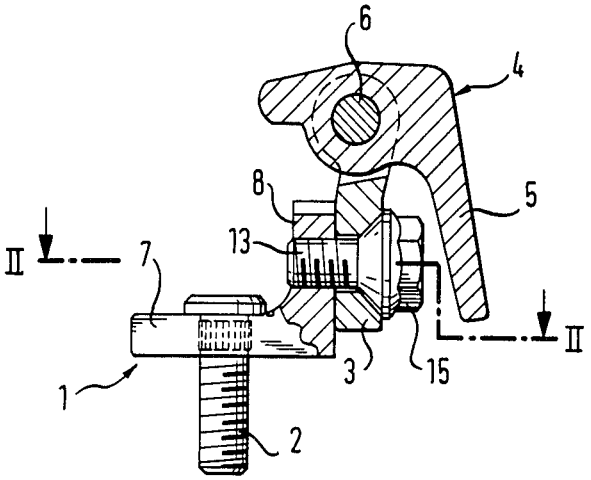
FIG. 1 is a front view, partly in section, of a hinge attachment arrangement taken along the line I—I in FIG. 2 and embodying the present invention.
Figure 2:
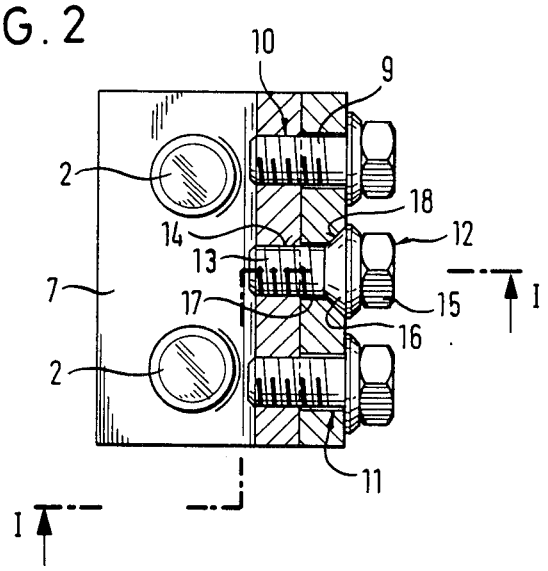
FIG. 2 is a top view, partly in section, of the hinge attachment arrangement shown in FIG. 1 taken along the line II—II in FIG. 1.

In FIGS. 1 and 2, a fastening element 1 is illustrated to be secured to the door strut of a vehicle body, not shown, and it is attached to the door strut by threaded bolts 2. In addition, the fastening element 1 is secured to one hinge wing 3 of a wing hinge 4 used for mounting a door on a motor vehicle. The other hinge wing 5 of the wing hinge 4 is fixed in a conventional manner to the vehicle door, not shown. The two hinge wings 3, 5 of the wing hinge 4 are interconnected by a hinge pin 6. In the various embodiments illustrated in the drawing, the fastening element 1 is in the form of an angle having a pair of legs 7, 8 with the leg 7 arranged to bear against the door strut and the leg 8 being fastened to the hinge wing 3 by threaded fastening bolts 9. In the embodiment shown in FIGS. 1 and 2, two fastening bolts are used. A tapped hole 10 is provided in the leg 8 of the fastening element 1 for receiving the threaded bolt 9. Aligned with the tapped holes 10 are drilled holes 11 in the hinge wing 3 and these holes are oversize relative to the diameter of the threaded bolts enabling these two components of the hinge attachment arrangement, that is, the hinge wing 3 and the fastening element 1, to align relative to one another. For the mutual alignment of the fastening element 1 and the hinge wing 3 in the embodiment shown in FIGS. 1 and 2, an attachment member or threaded bolt 12 is provided with a threaded portion 13 in engagement within a tapped hole in the fastening element 1 and with an axially extending tapered portion 16 formed on the bolt adjacent its head. A drilled through-hole 17 is provided in the hinge wing 3 aligned with the tapped hole 14 and coordinated with the threaded bolt 12, with the hole 17 being tapered for a portion 18 of its axial length and matching the taper of the threaded bolt 12.

Figure 3:
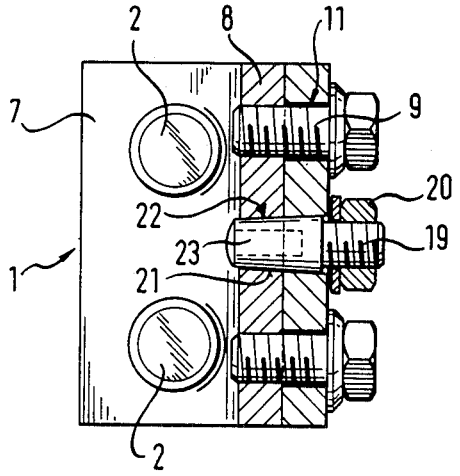
FIG. 3 is a top view, partly in section, of a second embodiment of the hinge attachment arrangement.

In the embodiment illustrated in FIG. 3, the hinge wing 3 arranged to be secured to the door frame of the vehicle is also attached to the leg 8 of the fastening element 1 by a pair of threaded bolts 9. In this embodiment, however, the mutual alignment of the fastening element 1 and the hinge wing 3, when the door is remounted on the vehicle body, is effected by a tapered plug 19 secured to the hinge wing 3. An attachment member or tapered plug 19 is secured to the hinge wing 3 by a threaded nut 20. The axially extending tapered shank portion 21 of the plug 19 fits into a cylindrical through-hole 22 in the leg 8 of the fastening element in the assembly of the hinge attachment arrangement so that first a certain mutual alignment of the hinge wing 3 relative to the fastening element 1 or its leg 8 is effected. The shank portion 21 of the tapered plug 19 has an axially extending cylindrically shaped drilled hole or blind bore 23 formed in its interior so that the shank portion can be spread apart after the assembly of the hinge attachment arrangement, such as by prying the plug open, thereby eliminating any play in the mutual alignment of the hinge wing 3 and the fastening element 1.

Figure 4:
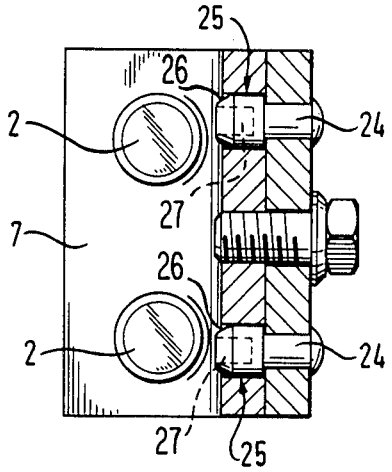
FIG. 4 is a top view, partly in section, of a third embodiment of the hinge attachment arrangement.

In the embodiment displayed in FIG. 4, a single threaded fastening bolt 9 is used to secure the hinge wing 3 to the leg 8 of the fastening element 1 arranged to be fitted on the door frame. A pair of attachment members or plugs 24 are arranged each on an opposite side of the through-hole 11 for the threaded bolt 9 extending through the hinge wing 3. The plugs 24 extend into cylindrical through-holes 25 in the leg 8 of the fastening element 1. The axially extending portion of the plugs projecting beyond the hinge wing 3 are essentially cylindrical with inwardly tapering sections 26 at their ends extending through the leg 8. Each plug 24 is provided with an axially extending internal cylindrically shaped hole or blind bore 27. The tapered end portions 26 of the plugs 24 afford a certain mutual alignment of the hinge wing 3 and the leg 8 of the fastening element 1 during the assembly of the hinge attachment arrangement and any play can be removed by spreading the end portions of the plugs apart, such as by prying, before the threaded bolt 9 is tightened. The rivet-like heads on the plugs 24 can be formed in an upsetting operation.

Figure 5:
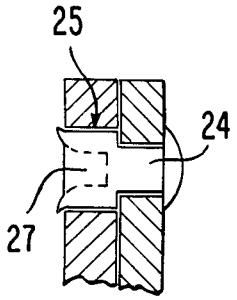
FIG. 5 is a view similar to FIG. 4 showing the expanded condition of the plug.

The blind bores formed in the ends of the plugs 19, 24 can be spread or pried radially outwardly by conventional tools in deforming the plug outwardly into play-free engagement with the hinge attachment arrangement, note the manner plug 24 is spread in FIG. 5.

While specific embodiments of the invention have been shown and described in detail to illustrate the application of the inventive principles, it will be understood that the invention may be embodied otherwise without departing from such principles.

I claim:

1. Hinge attachment arrangement for motor vehicle doors comprising a wing-type hinge including a vertically arranged first hinge wing, a vertically arranged second hinge wing, and a vertical hinge pin interconnecting said first and second hinge wings, said first hinge is arranged to be connected to a door on a vehicle, a fastening element is arranged to be attached to the door frame of the vehicle, said second hinge wing is arranged to be detachably fastened to said fastening element so that the vehicle door can be removed after it is aligned on the door frame for completing outfitting of the vehicle and then remounted in the final assembly, means forming guide surfaces disposed at least in part on one of said second hinge wing and said fatening element so that said guide surfaces slide relative to one another when assembling said hinge attachment arrangement, said fastening element and second hinge wing each having bearing surfaces therein in slidable contact with one another when said second hinge is fastened to said fastening element, said guide surfaces extend transversely to said bearing surfaces, wherein the improvement comprises that said second hinge wing having a first hole extending therethrough transversely of said bearing surfaces, said fastening element having a second hole extending therethrough in general alignment with the first hole in said second hinge wing, at least one fastening bolt separate from said guide surfaces for attaching said second hinge wing to said fastening element and extending through the first hole in said second hinge wing and through the second hole in said fastening element, said second hole in said fastening element being threaded for receiving said fastening bolt in threaded engagement and said first hole in said second hinge bearing having a larger diameter than said second hole so that with said fastening bolt extending through said first hole into said second hole there is play between the surface of said fastening bolt and said first hole, said means forming guide surfaces are shaped at least in part for providing self-centering of said second hinge wing relative to said fastening element and for eliminating play between said second hinge wing and said fastening element, at least one axially extending attachment member having a longitudinal axis and being secured at one end to at least one of said second hinge wing and fastening element, said at least one axially extending attachment member having a part extending along the longitudinal axis with the axis of said attachment member extending transversely of said bearing surfaces, a recess extending along the longitudinal axis from the other end toward said one end and formed in the axially extending part of said attachment member extending through the other one of said second hinge wing and fastening element and said attachment member forming a part of said guide surfaces and said attachment member having an axially extending conically shaped surface thereon that tapers toward the other end.

2. Hinge attachment arrangement, as set forth in claim 1, wherein said recessed part of said attachment member is spreadable in the radially outward direction relative to the axis of said attachment member.

3. Hinge attachment arrangement, as set forth in claim 2, wherein the recessed part in said attachment member is in the form of a slot-type axially extending recess extending for at least a part of the axial length of said attachment member.

4. Hinge attachment arrangement, as set forth in claim 1, wherein said attachment member is an axially extending threaded bolt having a bolt head at one end, a tapering frusto-conical section formed on said bolt extending axially from said bolt head, and said second hinge wing and fastening element each having a bore extending therethrough for receiving said bolt with a tapering frusto-conical section in said bore corresponding to said tapering frusto-conical section on said bolt.

5. Hinge attachment arrangement, as set forth in claim 1, wherein said attachment member comprises a tapered plug secured to one of said second hinge wing and fastening element, the one of said second hinge wing and fastening element to which the tapered plug is not secured has a cylindrically shaped bore therethrough for receiving said tapered plug and the recessed part of said plug extends axially in said cylindrically shaped bore.

6. Hinge attachment arrangement, as set forth in claim 1, wherein two said attachment members are provided each in the form of a plug and each is inserted into a corresponding bore extending through said second hinge wing and fastening element, each said plug having a first end secured against one of said second hinge wing and said fastening element and a second end extending through the other one of said second hinge wing and said fastening element and the end portion of said plug extending through the other one of said hinge wing and fastening element being tapered and at least a portion of the axially extending part of each said plug extending through the other one of said second hinge wing and fastening element containing an internal axially extending bore so that the axially extending part of said plug containing said bore can be spread radially outwardly.

7. Hinge attachment arrangement, as set forth in claim 1, wherein said recessed part of said attachment member is an axially extending cylindrically shaped drilled recess extending inwardly into said attachment member from the other end thereof.

* * * * *